US010683064B2

(12) United States Patent
Merchant et al.

(10) Patent No.: US 10,683,064 B2
(45) Date of Patent: Jun. 16, 2020

(54) PIPE-LIKE APPENDAGE FOR PONTOON STRUCTURE

(71) Applicant: Keppel Offshore & Marine Technology Centre Pte Ltd, Singapore (SG)

(72) Inventors: Aziz Amirali Merchant, Singapore (SG); Anis Altaf Hussain, Singapore (SG); Ankit Kumar Choudhary, Singapore (SG); Haihua Xu, Singapore (SG); Peifeng Ma, Singapore (SG)

(73) Assignee: KEPPEL OFFSHORE & MARINE TECHNOLOGY CENTRE PTE LTD, Singapore (SG)

( * ) Notice: Subject to any disclaimer, the term of this patent is extended or adjusted under 35 U.S.C. 154(b) by 0 days.

(21) Appl. No.: 16/060,402

(22) PCT Filed: Dec. 9, 2016

(86) PCT No.: PCT/SG2016/050596

§ 371 (c)(1),
(2) Date: Jun. 7, 2018

(87) PCT Pub. No.: WO2017/099670

PCT Pub. Date: Jun. 15, 2017

(65) Prior Publication Data

US 2019/0002060 A1 Jan. 3, 2019

(30) Foreign Application Priority Data

Dec. 9, 2015 (SG) ..... 10201510114Q

(51) Int. Cl.
*B63B 1/06* (2006.01)
*B63B 35/34* (2006.01)
(Continued)

(52) U.S. Cl.
CPC ..... *B63B 35/34* (2013.01); *B63B 1/32* (2013.01); *B63B 3/14* (2013.01); *B63B 9/00* (2013.01)

(58) Field of Classification Search
CPC .. B63B 1/32; B63B 35/34; B63B 3/14; B63B 9/00; B63B 1/06; B63B 1/063
See application file for complete search history.

(56) References Cited

U.S. PATENT DOCUMENTS 5,280,761 A * 1/1994 Karafiath ..... B63B 1/063 114/288
5,566,634 A * 10/1996 Petromanolakis ..... B63B 1/06 114/61.27

(Continued)

FOREIGN PATENT DOCUMENTS

KR 10-2010-0090991 8/2010
KR 10-2011-0026091 3/2011

(Continued)

OTHER PUBLICATIONS

International Search Report from Australian Patent Office dated Feb. 7, 2017 for relating International Application No. PCT/SG2016/050596.

(Continued)

*Primary Examiner* — Stephen P Avila
(74) *Attorney, Agent, or Firm* — Konrad Raynes Davda & Victor LLP; William P. Wilbar, IV

(57) ABSTRACT

This invention relates to a pipe-like appendage for a sharp-edged pontoon of an offshore vessel, a pontoon structure comprising the pipe-like appendage and a method of converting a sharp-edged pontoon into a pontoon comprising at least one rounded-edge.

10 Claims, 10 Drawing Sheets

(51) Int. Cl.

| | |
|---|---|
| ***B63B 9/00*** | (2006.01) |
| ***B63B 1/32*** | (2006.01) |
| ***B63B 3/14*** | (2006.01) |

(56) References Cited

U.S. PATENT DOCUMENTS

| | | | | |
|---|---|---|---|---|
| 5,676,087 | A * | 10/1997 | Baker | B63B 1/042 114/283 |
| 7,146,925 | B1 * | 12/2006 | Wilkie | B63B 1/02 114/354 |
| 2006/0169191 | A1 * | 8/2006 | Loui | B63B 1/063 114/274 |
| 2009/0188416 | A1 * | 7/2009 | Hickok | B63B 3/44 114/1 |
| 2014/0305359 | A1 | 10/2014 | Lambrakos et al. | |

FOREIGN PATENT DOCUMENTS

| | | |
|---|---|---|
| KR | 10-2013-0134667 | 12/2013 |
| KR | 10-2015-0043084 | 4/2015 |

OTHER PUBLICATIONS

Written Opinion from Australian Patent Office dated Feb. 7, 2017 for relating International Application No. PCT/SG2016/050596.

International Preliminary Report on Patentability from Australian Patent Office dated Nov. 22, 2017 for relating International Application No. PCT/SG2016/050596.

* cited by examiner

PIPE-LIKE APPENDAGE FOR PONTOON STRUCTURE

CROSS REFERENCED APPLICATIONS

This Application is a national stage filing of PCT Application PCT/SG2016/050596 filed Dec. 9, 2016 that claims priority to Singapore Patent Application No. 10201510114Q filed Dec. 9, 2016. Both of these application are hereby incorporated by reference as if set forth herewith.

FIELD OF THE INVENTION

This invention relates to a pipe-like appendage for a sharp-edged pontoon of an offshore vessel, a pontoon structure and a method of converting a sharp-edged pontoon into a pontoon comprising at least one rounded edge. In particular, the invention relates to a pipe-like appendage, a pontoon structure comprising the pipe-like appendage and a method of converting a sharp-edged pontoon into a pontoon comprising at least one rounded edge by affixing the pipe-like appendage to at least one of the edges of the pontoon structure.

BACKGROUND

Some conventional semi-submersible vessels have pontoons that have sharp edges (1) and corners (2) (see FIG. 1). Sharp edges or corners of the pontoons will induce strong flow separation and reverse flow (lower pressure) zone (3). The low pressure zone may remarkably increase the current drag on the pontoons in transit state.

The reverse flow (4), indicated by the shaded areas in FIG. 2, under the bow of a pontoon structure will affect the performance of thrusters which may experience fluctuating incoming flow while rotating.

Therefore, it is desirable to provide a pontoon structure with improved designs that seeks to address at least some of the problems encountered in conventional pontoon structure and/or at least to provide an alternative.

SUMMARY OF INVENTION

The problems in the art are solved and an advance in the art is made in accordance with some embodiments of this invention. In one aspect of the present invention, a pipe-like appendage for a sharp-edged pontoon of an offshore vessel is provided. The pipe-like appendage comprises a partially cylindrical body having an annular side wall, a closed first end and a closed second end, the annular side wall having an inner surface and an outer surface. The partially cylindrical body has, over its entire length, a partially circular or partially oval cross-section. The annular side wall of the pipe-like appendage forms an airfoil shape having a first edge inclined outwardly with respect to a first surface of the sharp-edged pontoon, and a second edge inclined outwardly with respect to a second surface of the sharp-edged pontoon such that the annular side wall encircles a sharp edge of the pontoon to form a rounded edge.

In accordance with some embodiments of this invention, the pipe-like appendage has a length sufficient to encircle about 80% to 100% of the entire length of the sharp edge of the pontoon. In another embodiment, the pipe-like appendage has a length sufficient to encircle the entire length of the sharp edge of the pontoon and two corner edges of the pontoon.

In accordance with many embodiments of this invention, the closed first end is tapered, with the narrow portion thereof away from the closed first end. In accordance with an embodiment of this invention, the closed second end is tapered, with the narrow portion thereof away from the closed second end.

In a second aspect of the present invention, a pontoon structure for an offshore vessel is provided. The pontoon structure comprises an elongated sharp-edged pontoon having four side surfaces, a stern end and a bow end, the elongated sharp-edged body having, over its length, a quadrangular cross-section; and a pipe-like appendage affixed to a bottom edge of the bow end of the elongated sharp-edged pontoon. The pipe-like appendage comprises a partially cylindrical body having an annular side wall, a closed first end and a closed second end, the annular side wall having an inner surface and an outer surface. The partially cylindrical body has, over its entire length, a partially circular or partially oval cross-section. The annular side wall of the pipe-like appendage forms an airfoil shape having a first edge inclined outwardly with respect to a first surface of the sharp-edged pontoon, and a second edge inclined outwardly with respect to a second surface of the sharp-edged pontoon such that the annular side wall encircles the bottom edge of the bow end of the sharp-edged pontoon to form a rounded edge.

In accordance with some embodiments of this invention, the pipe-like appendage encircles the bottom edge of the bow end of the sharp-edged pontoon and two corner edges of the bow end of the sharp-edged pontoon.

In a third aspect of the present invention, a method of converting a sharp-edged pontoon of an offshore vessel having four side surfaces, a stern end and a bow end into a pontoon having at least one rounded edge is provided. The method comprises affixing a pipe-like appendage of the present invention to a bottom edge of the bow end of the sharp-edged pontoon such that the annular side wall of the pipe-like appendage encircles the bottom edge of the bow end of the sharp-edged pontoon to form a rounded edge.

In accordance with many embodiments of this invention, the method comprises affixing the pipe-like appendage of the present invention to the bottom edge of the bow end of the sharp-edged pontoon such that the annular side wall of the pipe-like appendage encircles the bottom edge of the bow end of the sharp-edged pontoon and two corner edges of the bow end of the sharp-edged pontoon to form a rounded edge.

In accordance with a number of embodiments of this invention, the pipe-like appendage is affixed to the bottom edge of the bow end of the sharp-edged pontoon by welding.

BRIEF DESCRIPTION OF THE DRAWINGS

The above advantages and features of a system in accordance with this invention are described in the following detailed description and are shown in the drawings:

FIGS. 3A to 3E illustrate various exemplary configurations of the pipe-like appendage affixed to an edge of a sharp-edged pontoon in accordance with some embodiments of the present invention.

DETAILED DESCRIPTION

In the following description, numerous specific details are set forth in order to provide a thorough understanding of various illustrative embodiments of the invention. It will be understood, however, to one skilled in the art, that embodiments of the invention may be practiced without some or all of these specific details.

The some embodiments of the_present invention relate to a pipe-like appendage for a sharp-edged pontoon of an offshore vessel, a pontoon structure and a method of converting a sharp-edged pontoon into a pontoon comprising at least one rounded edge. In particular, the invention relates to a pipe-like appendage, a pontoon structure comprising the pipe-like appendage and a method of converting a sharp-edged pontoon into a pontoon comprising at least one rounded edge by affixing the pipe-like appendage to at least one of the edges of the pontoon structure.

Figure 4:
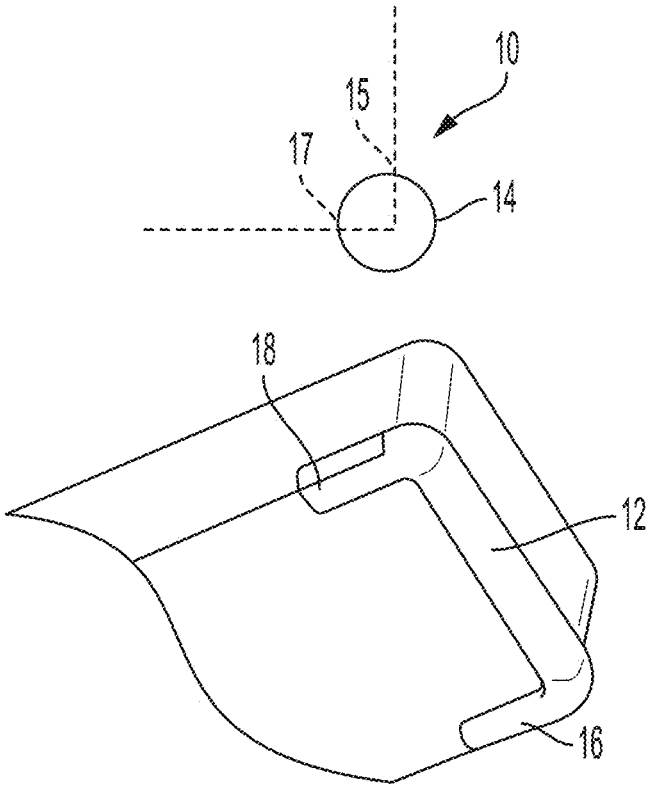
FIG. 4 shows a perspective view of a pontoon structure affixed with a pipe-like appendage A of the embodiment as shown in FIG. 3A, and an image showing the structure of the embodiment shown in FIG. 3A. The image shows that the reverse flow zones (4) are reduced by having a pipe-like appendage A affixed to the sharp edge of the pontoon structure.
Figure 4:
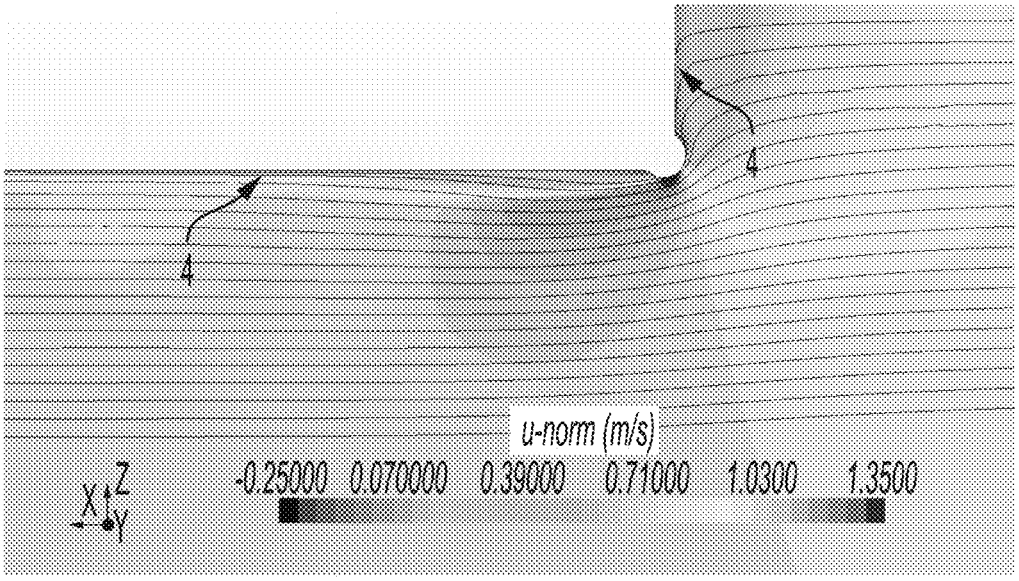
Figure 5:
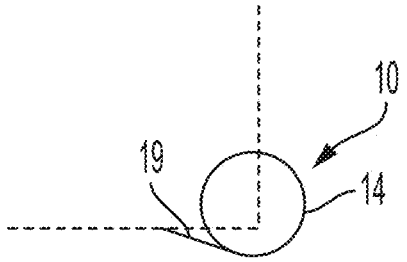
FIG. 5 shows a perspective view of a pontoon structure affixed with a pipe-like appendage B of the embodiment shown in FIG. 3C, and an image showing the flow field surrounding the rounded edge at the bottom of the bow end of the pontoon structure of the embodiment shown in FIG. 3C. The image shows that the reverse flow zones (4) are reduced by having a pipe-like appendage B affixed to the sharp edge of the pontoon structure.
Figure 5:
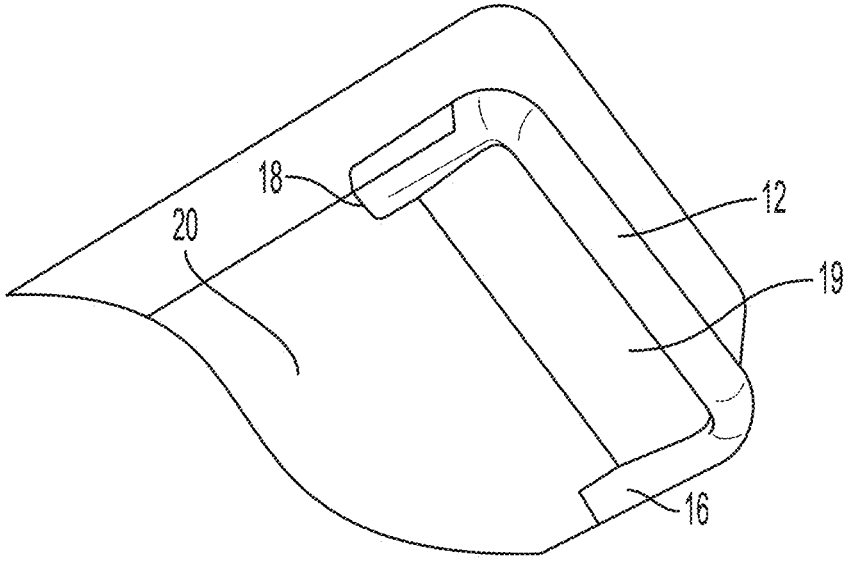
Figure 5:
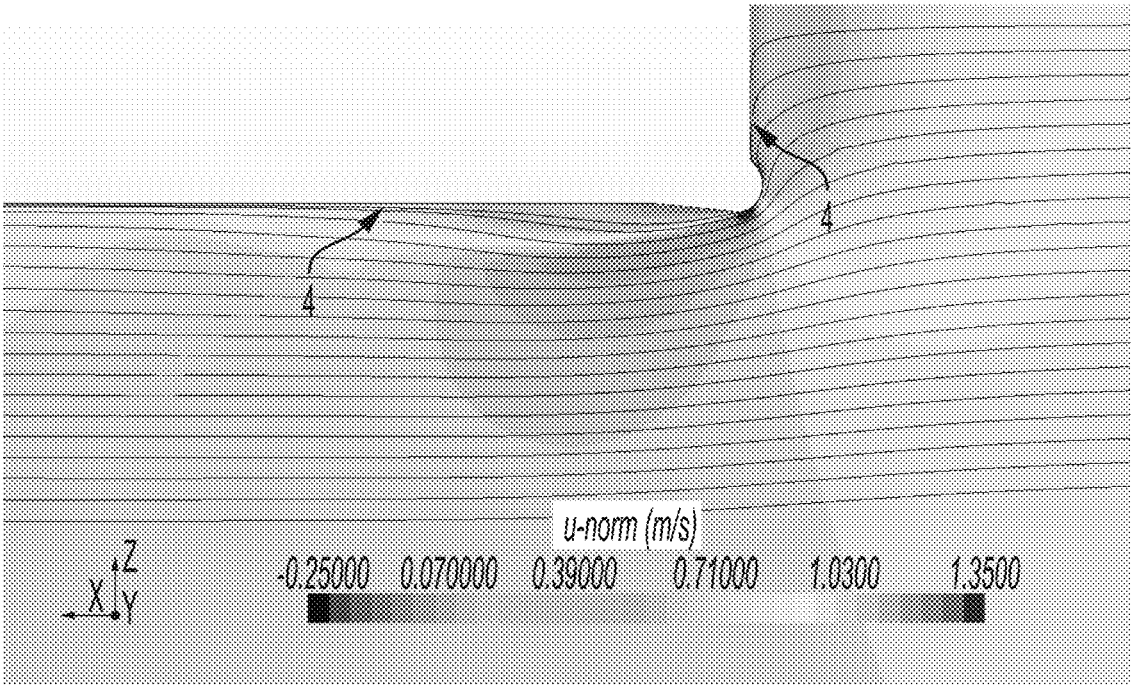
Figure 6:
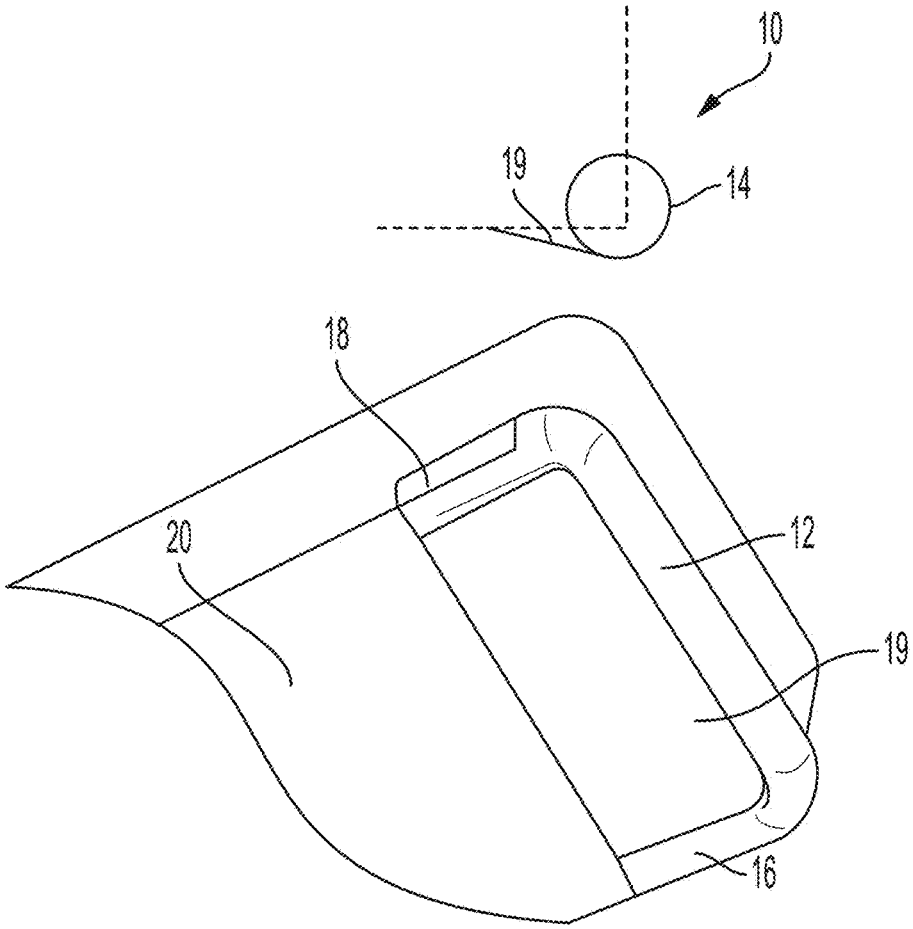
FIG. 6 shows a perspective view of a pontoon structure affixed with a pipe-like appendage C of the embodiment shown in FIG. 3D, and an image showing the flow field surrounding the rounded edge at the bottom of the bow end of the pontoon structure of the embodiment shown in FIG. 3D. The image shows that the reverse flow zones (4) are reduced by having a pipe-like appendage C affixed to the sharp edge of the pontoon structure.
Figure 6:
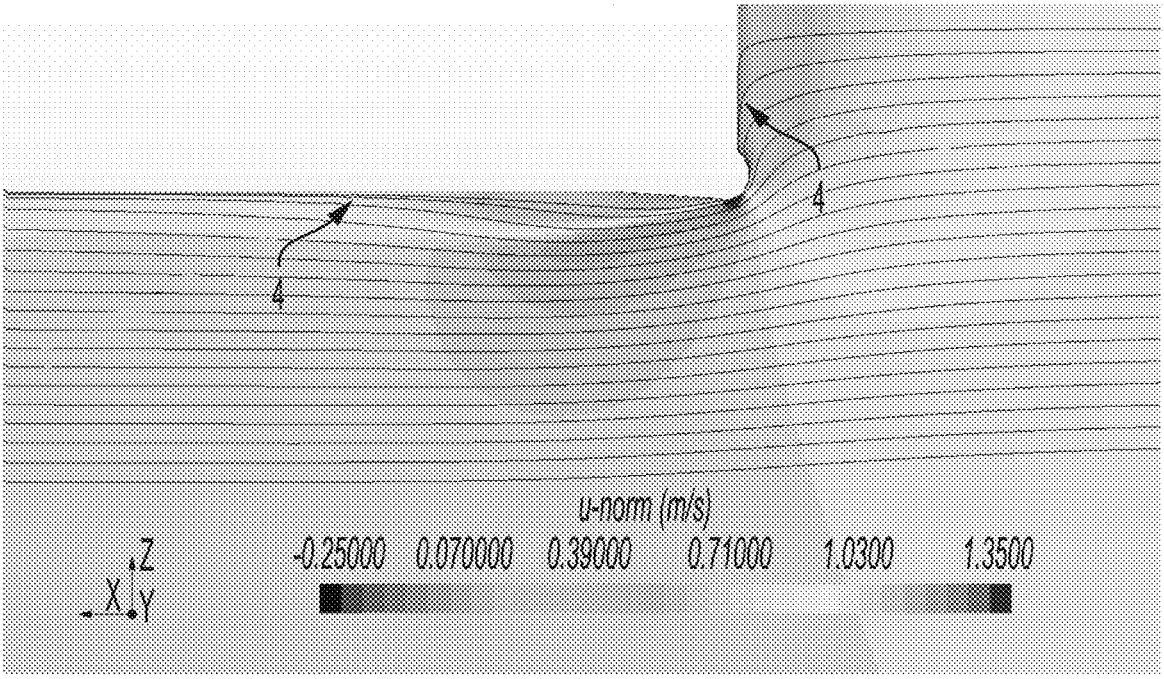

Referring to FIGS. 4-6, there is shown a pipe-like appendage (10) for a sharp-edged pontoon of an offshore vessel. The pipe-like appendage (10) comprises a partially cylindrical body (12) having an annular side wall (14), and a closed first end (16) and a closed second end (18). The annular side wall (14) has an inner surface and an outer surface.

Figure 1:
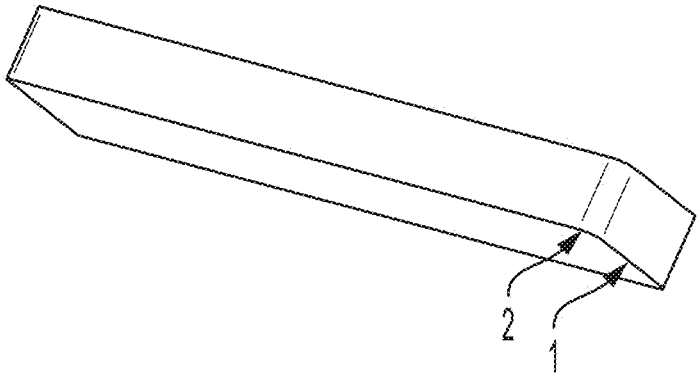
Figure 1 PRIOR ART
FIG. 1 illustrates a conventional sharp-edged pontoon having sharp edges at the bottom of the pontoon.
Figure 2:
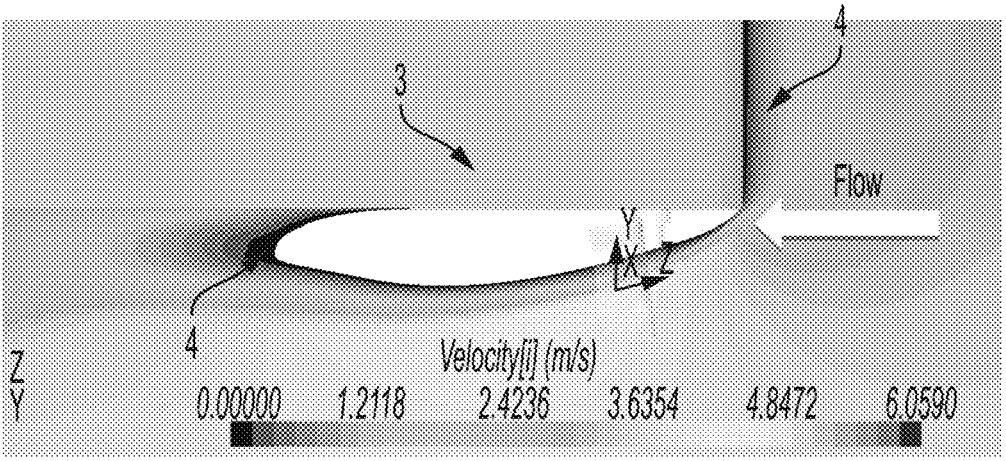
Figure 2 PRIOR ART
FIG. 2 is an image showing a flow field surrounding an edge at the bottom of the bow end of a conventional sharp-edged pontoon of FIG. 1.
Figure 3A:
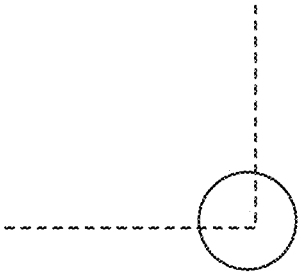
Figure 3B:
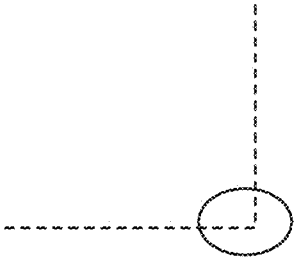
Figure 3C:
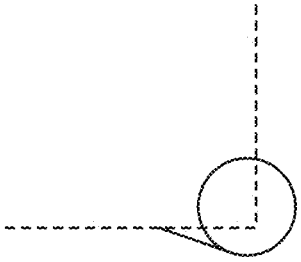
Figure 3D:
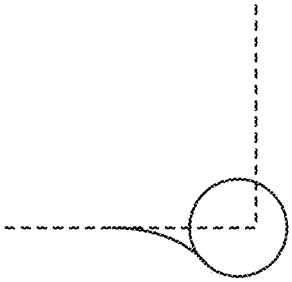
Figure 3D:
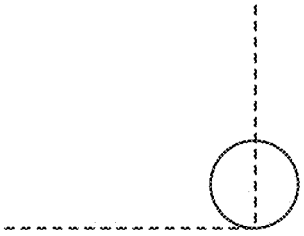

Various embodiments of the pipe-like appendage in accordance with some embodiments_of the present invention are provided. In some of these_embodiments of the invention, the partially cylindrical body (12) has, over its entire length, a partially circular (or C-shaped) cross section. FIGS. 3A and 3C-3D show some exemplary embodiments of this configuration. In some other embodiments of the invention, the partially cylindrical body (12) has, over its entire length, a partially oval cross section (see FIG. 3B).

The annular side wall (14) of the pipe-like appendage forms an airfoil shape having a first edge (15) inclined outwardly with respect to a first surface of the sharp-edged pontoon, and a second edge (17) inclined outwardly with respect to a second surface of the sharp-edged pontoon such that the annual side wall (14) encircles a sharp edge of the pontoon to form a rounded edge when the pipe-like appendage is affixed to the pontoon structure. The annular side wall (14) can be of any suitable thickness without departing from the scope of the present invention.

The pipe-like appendage can be of any suitable length, depending on the length of the edges of the sharp-edged pontoon. In accordance with_one embodiment, the length of the pipe-like appendage is sufficient to cover about 80% to 100% of the entire length of the sharp edge of the pontoon that it intends to covers. In accordance with another embodiment, the pipe-like appendage has a length sufficient to encircle the entire length of the sharp edge of the pontoon and two corner edges of the pontoon. The diameter of the pipe-like appendage may vary depending on the rounded edge that is to be created. The pipe-like appendage of many embodiments of the present invention can be made of any suitable material including, but not limited to, steel and stainless steel.

In a number of embodiments, the closed first end (16) and the closed second end (18) of the pipe-like appendage are tapered, with the narrower portion thereof away from its respective closed end. In other embodiments, the closed first end (16) and the closed second end (18) are not tapered.

In accordance with some other embodiments, the pipe-like appendage (10) may further include one or two plate (19) extending from the outer surface of the annular side wall (14), such that when the pipe-like appendage (10) is affixed to the pontoon structure (20), the plate (19) inclines at an angle with respect to the bottom surface of the pontoon structure (20). FIG. 5 and FIG. 6 show exemplary embodiments of this configuration.

In a second aspect of the present invention, a pontoon structure for an offshore vessel comprising the pipe-like appendage of the present invention is provided. The pontoon structure (20) comprises an elongated sharp-edged body having four side surfaces, a stern end and a bow end, the elongated sharp-edged body having, over its length, a quadrangular cross-section; and a pipe-like appendage (10) affixed to a bottom edge of the bow end of the elongated sharp-edged body. The pipe-like appendage is in accordance with the pipe-like appendage as described hereinabove.

Figure 9A:
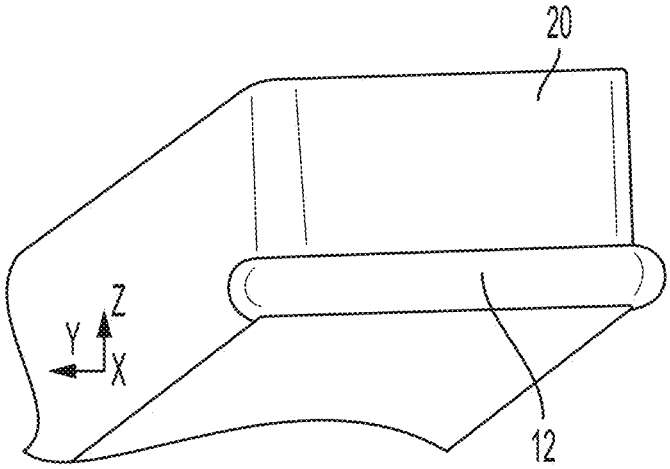
FIG. 9A shows a perspective view of still another embodiment of a pontoon structure affixed with a pipe-like appendage F of another embodiment of the present invention.
Figure 9B:
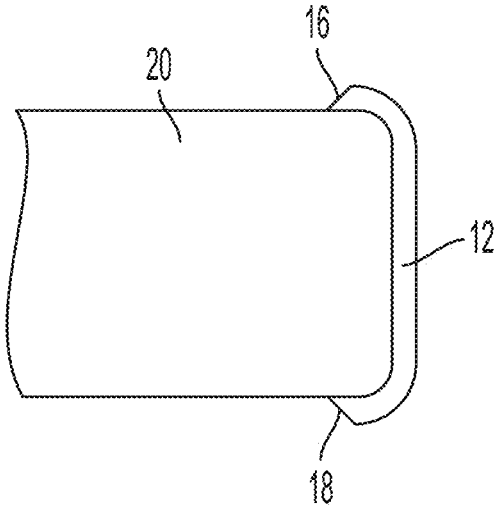
FIG. 9B shows a top view of the embodiment of FIG. 9A.

In accordance with some embodiments of the present invention, the annular side wall (14) of the pipe-like appendage (10) is configured such that it encircles the bottom edge of the bow end of the sharp-edged pontoon to form a rounded edge. In another embodiment, the annular side wall (14) of the pipe-like appendage (10) encircles the bottom edge of the bow end of the sharp-edged pontoon, with the closed first end (16) of the pipe-like appendage extends to encircle a corner edge of the bow end of the sharp-edged pontoon and the closed second end (18) extends to encircle a second corner edge of the bow end of the sharp-edged pontoon. An example of a configuration in accordance with embodiment of this invention is shown in FIG. 9.

Figure 7:
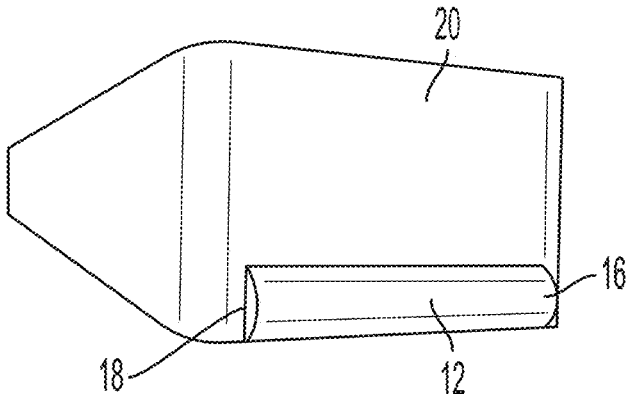
FIG. 7 is a perspective view of an embodiment of a pontoon structure affixed with a pipe-like appendage D of the present invention.
Figure 8:
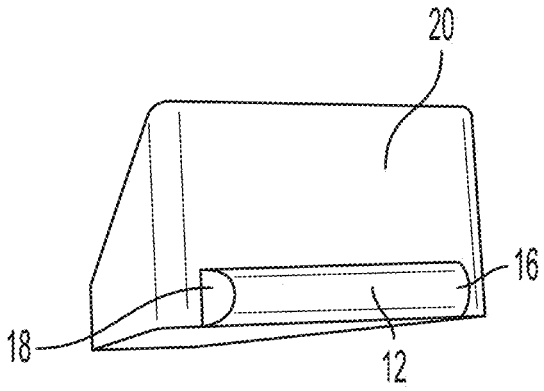
FIG. 8 is a perspective view of another embodiment of a pontoon structure affixed with a pipe-like appendage E of another embodiment of the present invention.

As described hereinabove, in some embodiments, the closed first end (16) and the closed second end (18) of the pipe-like appendage may be tapered, with the narrower portion thereof away from its respective closed. FIG. 9 shows an embodiment of a pontoon structure with the pipe-like appendage of this configuration. In other embodiments, the closed first end (16) and the closed second end (18) are not tapered. FIG. 7 and FIG. 8 show other embodiments of a pontoon structure with the pipe-like appendage of this configuration.

The pontoon structure in accordance with an embodiment_of the present invention may further include a second pipe-like appendage affixed to a bottom edge of the stern end of the sharp-edged pontoon. In some embodiments, the second pipe-like appendage encircles the bottom edge of the stern end of the sharp-edge pontoon, with the closed first end of the second pipe-like appendage extends to encircle a corner edge of the stern end of the sharp-edged pontoon and the closed second end extends to encircle a second corner edge of the stern end of the sharp-edged pontoon.

In a third aspect of the present invention, a method of converting a sharp-edge pontoon of an offshore vessel to a pontoon having at least one rounded edge is provided. In some embodiments of the invention, the method comprises affixing a pipe-like appendage of the present invention to a bottom edge of the bow end of the sharp-edged pontoon such that the annular side wall of the pipe-like appendage encircles the bottom edge of the bow end of the sharp-edged pontoon to form a rounded edge.

In accordance with some other embodiments, the method comprises affixing the pipe-like appendage in accordance with a number of embodiments of the present invention to the bottom edge of the bow end of the sharp-edged pontoon such that the pipe-like appendage encircles the bottom edge of the bow end of the sharp-edged pontoon and two corner edges of the bow end of the sharp-edged pontoon to form a rounded edge.

The method may further comprise affixing a second pipe-like appendage to a bottom edge of the stern end of the sharp-edged pontoon such that the pipe-like appendage encircles the bottom edge of the stern end of the sharp-edged pontoon to form a rounded edge. In another embodiment, the method may further comprise affixing the pipe-like appendage of the present invention to the bottom edge of the stern end of the sharp-edged pontoon such that the pipe-like appendage encircles the bottom edge of the stern end of the sharp-edged pontoon and two corner edges of the stern end of the sharp-edged pontoon to form a rounded edge.

The pipe-like appendage can be affixed to any one of the edges of the sharp-edged pontoon using any suitable methods known in the art including, but not limited to, welding. The pipe-like appendage can be affixed to any type of sharp-edged pontoon structure without departing from various embodiments of the invention.

The pipe-like appendage, the pontoon structure and the method of the present invention have several advantages. The pipe-like appendage of the present invention helps to form a more streamlined flow and thereby reduces the reverse flow (low pressure) zone of the pontoon structure. This configuration of the pontoon structure significantly reduces the reverse flow zone around the forward thruster and this in turn improves the thruster performance by reducing the fluctuation experienced by the propellers of the thrusters.

The pontoon structure in accordance with some embodiments of the present invention is configured to reduce the total drag of a floating structure or vessel. The results obtained suggest that the total drag is significantly reduced by the addition of a simple appendage to at least one of the sharp edges at the bottom of the pontoon structure, particularly to the bottom edge of the bow end of the pontoon structure. The addition of a simple pipe-like appendage to the pontoon bow is able to reduce the total drag on the pontoon structure by 25% to 45% (see Table 1 below).

The method of the present invention provides a simple and cost effective solution to convert a conventional floating structure or vessel, for example, semi-submersible vessel to a floating structure or vessel that has a relatively lower drag as compared to a conventional floating structure or vessel, with no change to the major dimensions of the floating structure or vessel.

The following examples are provided to further illustrate and describe particular embodiments of the present invention, and are in no way to be construed to limit the invention to the specific procedures, conditions or embodiments described therein.

EXAMPLES

Tests were carried out to determine the reduction in drag force of the various embodiments of the pontoon structure comprising the pipe-like appendage in accordance with some embodiments of the present invention.

In this example, a pipe-like appendage is affixed to an edge at the bottom of the bow end of the pontoon structure according to the arrangements as shown in FIGS. 4-9. The results obtained for the various embodiments of the present invention are shown in Table 1 below.

TABLE 1

| | Appendage A (FIG. 4) | Appendage B (FIG. 5) | Appendage C (FIG. 6) | Appendage D (FIG. 7) | Appendage E (FIG. 8) | Appendage F (FIG. 9) |
|---|---|---|---|---|---|---|
| Reduction in drag (%) | 35.2 | 32.0 | 32.4 | 40.8 | 36.8 | 25.1 |

The above results show that due to the removal of large low pressure zone, the total drag at 7 knot transit speed can significantly be reduced by more than 25% by the addition of a pipe-like appendage to an edge at the bottom of the bow end of the pontoon structure.

Figure 10:
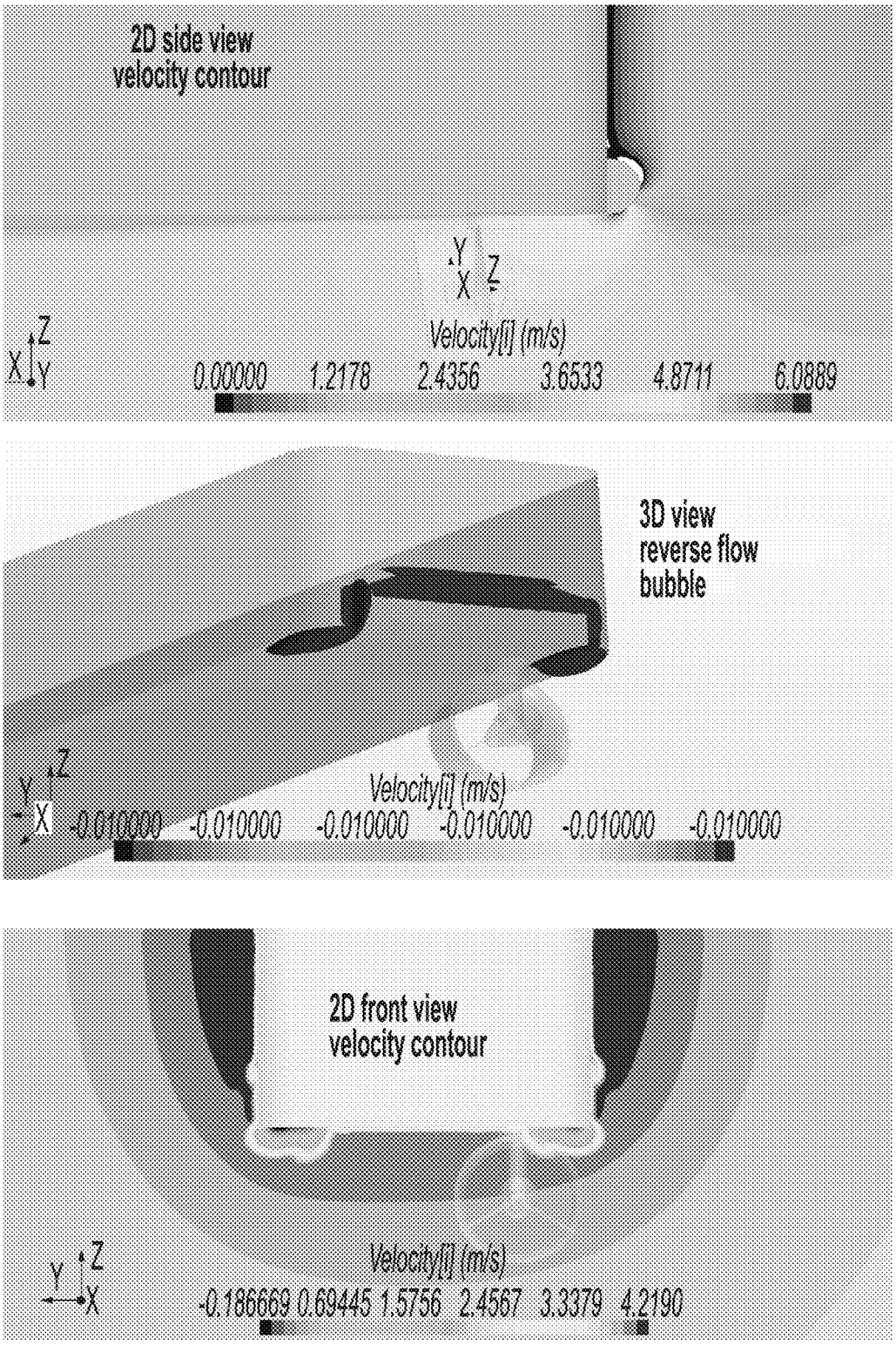
FIG. 10 shows a 2D side view of the velocity contour, a 3D view of reverse flow bubble and a 2D front view of the velocity contour of the embodiment of FIG. 7. This figure shows that no reverse flow is observed in the thruster region.
Figure 11:
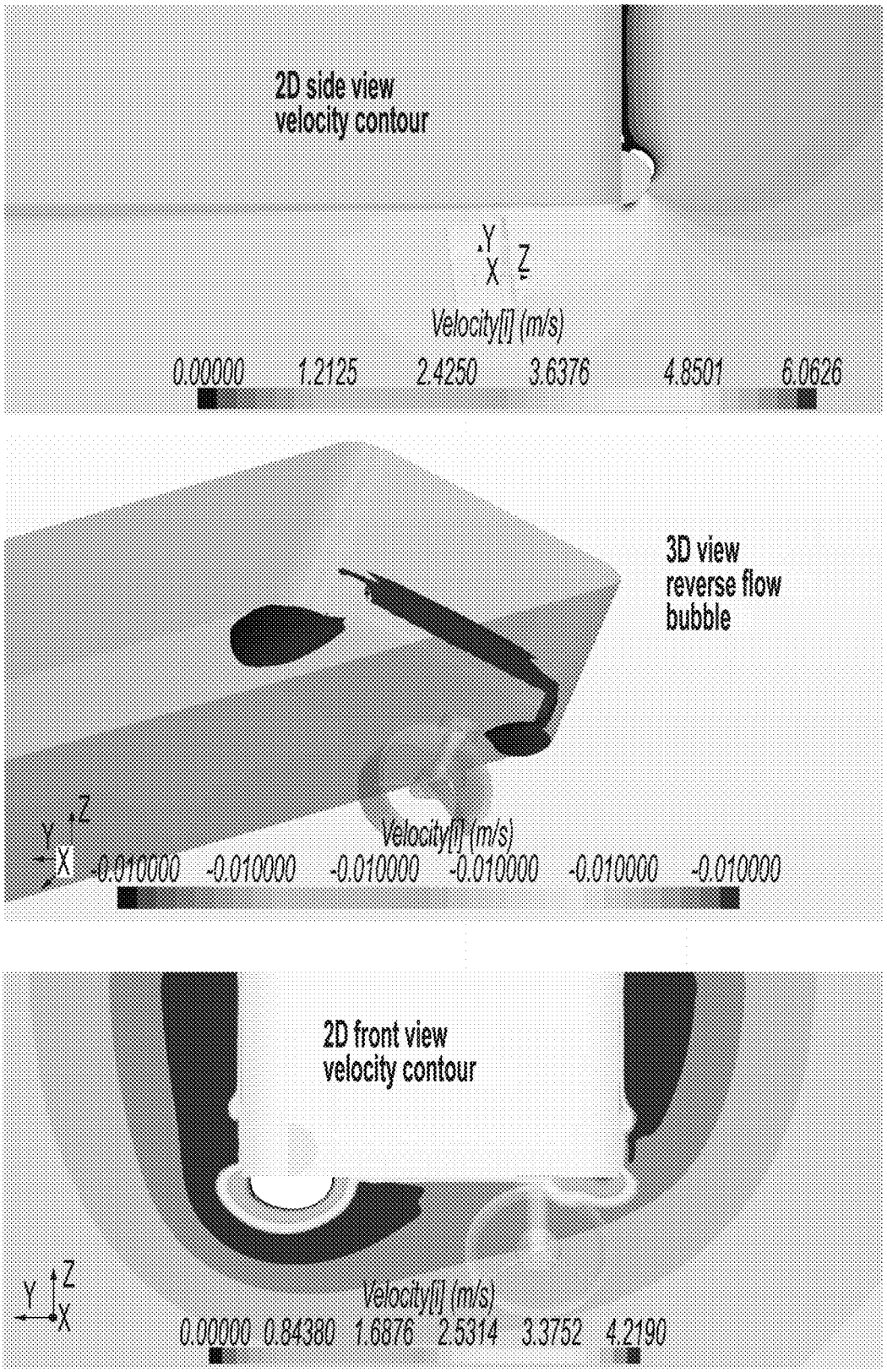
FIG. 11 shows a 2D side view of the velocity contour, a 3D view of reverse flow bubble and a 2D front view of the velocity contour of the embodiment of FIG. 8. This figure shows that no reverse flow is observed in the thruster region.
Figure 12:
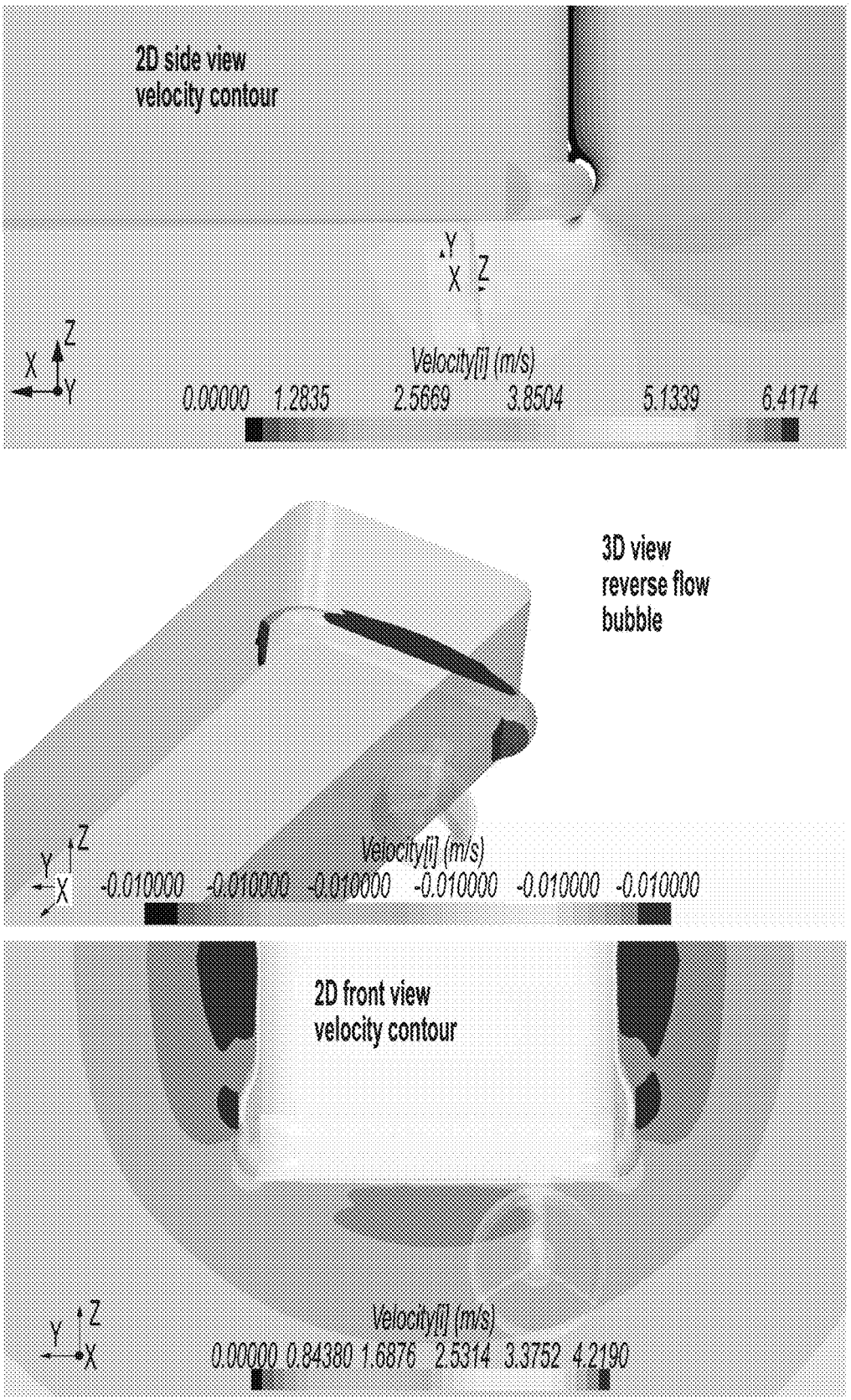
FIG. 12 shows a 2D side view of the velocity contour, a 3D view of reverse flow bubble and a 2D front view of the velocity contour of the embodiment of FIG. 9. This figure shows that no reverse flow is observed in the thruster region.

FIGS. 10, 11 and 12 each shows a 2D side view of the velocity contour, a 3D view of reverse flow bubble and a 2D front view of the velocity contour of the embodiment shown in FIG. 7 (Appendage D), FIG. 8 (Appendage E) and FIG. 9 (Appendage F) respectively. From FIGS. 10-12, we can see that no reverse flow is observed in the thruster region in each of the embodiments.

The above is a description of the subject matter the inventors regard as the invention and is believed that others can and will design alternative systems that include this invention based on the above disclosure.

The invention claimed is:

1. A pipe-like appendage for a sharp-edged pontoon of an offshore vessel, the pipe-like appendage comprising:

a partially cylindrical body having an annular side wall, a closed first end and a closed second end, the annular side wall having an inner surface and an outer surface;

wherein the partially cylindrical body having, over its entire length, a partially circular or partially oval cross-section;

wherein the annular side wall is configured to form an airfoil shape having a first edge inclined outwardly with respect to a first surface of a sharp-edged pontoon, and a second edge inclined outwardly with respect to a second surface of the sharp-edged pontoon such that the annular side wall encircles a sharp edge of the pontoon to form a rounded edge;

wherein the closed first end is tapered, with the narrow portion thereof away from the closed first end, and the closed second end is tapered, with the narrow portion thereof away from the closed second end; and wherein the pipe-like appendage having a length sufficient to encircle the entire length of the sharp edge of the pontoon and two corner edges of the pontoon.

2. The pipe-like appendage according to claim 1, wherein the pipe-like appendage is made of material selected from the group consisting of steel and stainless steel.

3. A pontoon structure for an offshore vessel, the pontoon structure comprising:

an elongated sharp-edged pontoon having four side surfaces, a stern end and a bow end, the elongated sharp-edged body having, over its length, a quadrangular cross-section; and a pipe-like appendage affixed to a bottom edge of the bow end of the elongated sharp-edged pontoon, the pipe-like appendage comprises:

a partially cylindrical body having an annular side wall, a closed first end and a closed second end, the annular side wall having an inner surface and an outer surface;

wherein the partially cylindrical body having, over its entire length, a partially circular or partially oval cross-section;

wherein the annular side wall is configured to form an airfoil shape having a first edge inclined outwardly with respect to a first surface of the sharp-edged pontoon, and a second edge inclined outwardly with respect to a second surface of the sharp-edged pontoon such that the annular side wall encircles the bottom edge of the bow end of the sharp-edged pontoon to form a rounded edge;

wherein the closed first end is tapered, with the narrow portion thereof away from the closed first end, and the closed second end is tapered, with the narrow portion thereof away from the closed second end; and wherein the pipe-like appendage having a length sufficient to encircle the entire length of the bottom edge and two corner edges of the bow end of the sharp-edged pontoon.

4. The pontoon structure according to claim 3, further comprising:

a second pipe-like appendage affixed to a bottom edge of the stern end of the sharp-edged pontoon.

5. The pontoon structure according to claim 4, wherein the second pipe-like appendage encircles the bottom edge of the stern end of the sharp-edge pontoon and two corner edges of the stern end of the sharp-edge pontoon.

6. The pontoon structure according to claim 3, further comprising:

a plate extending from the outer surface of the annular side wall of the pipe-like appendage and forming an angle with respect to the second surface of the sharp-edged pontoon.

7. A method of converting a sharp-edged pontoon of an offshore vessel having four side surfaces, a stern end and a bow end into a pontoon having at least one rounded edge, the method comprising:

affixing a pipe-like appendage to a bottom edge of the bow end of the sharp-edged pontoon, the pipe-like appendage comprises:

a partially cylindrical body having an annular side wall, a closed first end and a closed second end, the annular side wall having an inner surface and an outer surface;

wherein the partially cylindrical body having, over its entire length, a partially circular or partially oval cross-section;

wherein the annular side wall is configured to form an airfoil shape having a first edge inclined outwardly with respect to a first surface of the sharp-edged pontoon, and a second edge inclined outwardly with respect to a second surface of the sharp-edged pontoon such that the annular side wall encircles the bottom edge of the bow end of the sharp-edged pontoon to form a rounded edge;

wherein the closed first end is tapered, with the narrow portion thereof away from the closed first end, and the closed second end is tapered, with the narrow portion thereof away from the closed second end; and wherein the pipe-like appendage having a length sufficient to encircle the entire length of the bottom edge and two corner edges of the bow end of the sharp-edged pontoon.

8. The method according to claim 7, wherein the pipe-like appendage is affixed to the bottom edge of the bow end of the sharp-edged pontoon by welding.

9. The method according to claim 7, further comprising:

affixing a second pipe-like appendage to a bottom edge of the stern end of the sharp-edged pontoon.

10. The method according to claim 9, wherein the second pipe-like appendage encircles the bottom edge of the stern end of the sharp-edged pontoon and two corner edges of the stern end of the sharp-edged pontoon.

* * * * *